US006901720B2

(12) United States Patent
Lechner et al.

(10) Patent No.: US 6,901,720 B2
(45) Date of Patent: Jun. 7, 2005

(54) BEVERAGE BOTTLING PLANT FOR FILLING BOTTLES WITH A LIQUID BEVERAGE FILLING MATERIAL, AND APPARATUS FOR ATTACHING CARRYING GRIPS TO CONTAINERS WITH FILLED BOTTLES

(75) Inventors: Tilo Lechner, Emmerich (DE); Ludger Pauls, Ven-Zelderheide (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 10/816,787

(22) Filed: Apr. 2, 2004

(65) Prior Publication Data

US 2004/0261362 A1 Dec. 30, 2004

(30) Foreign Application Priority Data

Apr. 3, 2003 (DE) ..... 103 15 116

(51) Int. Cl.[7] ..... B65B 1/04; B65B 6/14

(52) U.S. Cl. ..... 53/134.1; 53/167; 53/284.5

(58) Field of Search ..... 53/134.1, 136.1, 53/167, 284.5; 156/362, 556; 493/88, 909

(56) References Cited

U.S. PATENT DOCUMENTS

| | | | | |
|---|---|---|---|---|
| 3,834,970 A | * | 9/1974 | Mitsuoka et al. | 493/909 |
| 4,422,281 A | * | 12/1983 | Rensner | 53/134.1 |
| 4,745,727 A | * | 5/1988 | Cinotti | 53/134.1 |
| 4,906,319 A | | 3/1990 | Fiorani | |
| 5,052,165 A | | 10/1991 | Gunther | |
| 5,062,251 A | | 11/1991 | Gunther | |
| 5,079,900 A | * | 1/1992 | Pinckney et al. | 53/413 |
| 5,081,817 A | * | 1/1992 | Nesbitt | 53/134.1 |
| 5,458,726 A | | 10/1995 | Castoldi | |

FOREIGN PATENT DOCUMENTS

| | | |
|---|---|---|
| DE | 3715445 | 11/1986 |
| DE | 69300175 | 2/1996 |
| DE | 69308878 | 8/1997 |
| DE | 10017041 | 10/2001 |
| DE | 20207217 | 9/2002 |

* cited by examiner

*Primary Examiner*—John Sipos
(74) *Attorney, Agent, or Firm*—Nils H. Ljungman & Associates

(57) ABSTRACT

A beverage bottling plant for filling bottles with a liquid beverage filling material, and apparatus for attaching carrying grips to containers with filled bottles. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 3 Drawing Sheets

BEVERAGE BOTTLING PLANT FOR FILLING BOTTLES WITH A LIQUID BEVERAGE FILLING MATERIAL, AND APPARATUS FOR ATTACHING CARRYING GRIPS TO CONTAINERS WITH FILLED BOTTLES

BACKGROUND

1. Technical Field

The application relates to a beverage bottling plant for filling bottles with a liquid beverage filling material, and apparatus for attaching carrying grips to containers with filled bottles.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus being configured to introduce a predetermined volume of liquid beverage filling material into the interior of bottles to a substantially predetermined level of liquid beverage filling material, and the apparatus configured to introduce a predetermined flow of liquid beverage filling material comprising apparatus being configured to terminate the filling of beverage bottles upon liquid beverage filling material reaching said substantially predetermined level in bottles. There may also be provided a conveyer arrangement being configured and disposed to move bottles, for example, from an inspecting machine to the filling machine. Upon filling, a closing station closes filled bottles. There may further be provided a conveyer arrangement configured to transfer filled bottles from the filling machine to the closing station. Next, filled bottles are usually labeled in a labeling station after closing. Filled bottles are then possibly combined in containers, such as six-pack containers, for example.

Thus, all kinds of wares are nowadays generally offered in packages, so as to simplify transportation, afford protection of the wares as such against damage and loss, and they are thus made more appealing, leading to an increased sales turnover.

As well, individually packaged wares, such as, for example, beverages filled in bottles, are gathered into larger units. These are then assembled, for example, as so-called tray-packs. In such tray-pack assemblies, for example, six bottles are combined into a mechanically stable sales unit by way of a cardboard bottom and a shrink-wrap foil envelope. In other assemblies, greater numbers of bottles, such 8, 10, 12, 16, 18, or 24 bottles, can be combined and packaged in a single assembly.

So as to increase the customer service, many market participants welcome the provision of a carrying grip, strip, or handle for all the types of packaging described above that is either already attached, or it is desired that such packaging is conducive to being provided with a carrying grip.

In the following, all packaging, bottles, cans, assemblies and so forth known in the field are referred to as containers for reasons of simplicity.

In most cases in which containers are equipped with a carrying grip, the carrying grip comprises a plastic band that has a self-adhesive on one side thereof. While the first portion and the last portion of such plastic band are respectively pressed onto respective sides of the container and are secured by the adhesive, the adhesive side of the central portion is then covered, as a rule, by a strip of paper so as preclude contact of the fingers of a customer with the adhesive, and with the central portion providing the carrying loop of the carrying grip.

The art comprises basically two methods for the production of such plastic bands. In a first method, the bands are equipped with the above-described strip of paper during the manufacture, such that these strips need only to be brought to the finished length and need only to be attached within the machine that serves to attach the carrying grips.

However, it is of detriment in this method that each change of the configuration of the carrying grip will entail a change of the plastic strip, whether it be the total length, the length of an adhesive portion, or the length of the carrying loop.

In a second method initially a plastic strip is used which is fully self-adhesive on one side. Within the machine that attaches the carrying grips, there is now attached to the portion of this plastic strip that is disposed between the desired adhesive locations a strip of paper, whereby the required adhesive locations at the leading end and at the trailing end of the strip are left free of such a paper strip. This method obviates a frequent change of the plastic strip, which is of particular advantage in practical use, since the length of the plastic strip, as well as the position and the length of the paper strip, can be adapted in simple manner to changes in requirements.

All comments made herein above in connection with plastic strips apply in analogous manner for the use of starting materials that are made of other materials, such as, for example, paper or metal, or that are made of any desired combination of such materials.

Concerning machines that attach carrying grips, hereinafter referred to as carrying grip dispensers, hitherto several solution suggestions have become known.

One arrangement for attaching carrying grips was introduced by German Utility Model No. 20 207 217, published on Sep. 19, 2002. In this arrangement the applicator tool consists essentially of a three-arm rotor, the horizontal axis of rotation of which is disposed transversely with respect to the conveying direction of the containers. Each one of these rotor arms is equipped with a guide for a strip, a holding tool, and a cutting tool. Between the rotor arms, near the hub of the rotor, there is respectively one vacuum probe that is to pull the plastic strip without contact such that the plastic strip does not connect the ends of the rotor arms in a straight line but essentially follows the inner contour of the rotor. The actual attaching of the carrying grip is achieved in that the containers are driven against a first rotor arm and thereby take up the leading end of the carrying grip. Subsequently, the containers are driven beneath the rotating rotor and are provided by the respectively succeeding rotor arm with the trailing end of the carrying grip, whereby the cutting tool that is disposed at the end of the respective rotor arm severs the plastic strip in proper division.

Of major detriment of an arrangement according to German Utility Model No. 20 207 217 is the fact that the geometric configuration of the rotor determines the length of the carrying grip that is to be processed. Due to this fact, it becomes necessary, as a rule, that when changes arise in the containers or, respectively, the dimensions thereof, to exchange the rotor, and this is time consuming and expensive. It is also a disadvantage that the vacuum action of the plastic strip towards the hub between two rotor arms provides a source for errors in practical use. German Utility Model No. 202 07 217 is hereby incorporated by reference as if set forth in its entirety herein.

Another arrangement has become known in German Patent No. DE 3 715 445 filed on May 8, 1987, in which the carrying grip is attached by a comparatively complex arrangement of various levers and presser rollers. It is of disadvantage that this arrangement is essentially only useable for box, carton, or parcel-type containers, and that an adaptation of the carrying grip to changing container dimensions is possible to a limited extent only. German Patent No. 3 715 445 and corresponding U.S. Pat. No. 5,052,165 issued to Gunther on Oct. 1, 1991 and U.S. Pat. No. 5,062,251 issued to Gunther on Nov. 5, 1991 are hereby incorporated by reference as if set forth in their entirety herein.

A further arrangement has been introduced in German Patent No. DE 693 00 175, published Feb. 15, 1996. The arrangement has a rotary plate that can be driven and that is disposed transversely with respect to the direction of travel of the containers. The radially outer ends of the rotary plate are respectively rounded and are equipped with two L-shaped levers that serve as holding means for fixing the endless band that has on one side an adhesive layer, portions of which are covered, as well as being equipped with a cutter that serves as a cutting tool for cutting of the carrying grip from the plastic strip, which cutter can be moved radially in an outward direction. At the commencement of the process, the rotary plate is disposed vertically and reaches with a first end into the path of the containers, whereby on the side that is facing towards the containers, a portion of the plastic strip that corresponds to the length of the carrying strip that is to be established is held between the two ends of the rotary plate, with the adhesive layer being directed outwardly. An arriving container then meets the rotary plate with its forward side, as considered in reference to the direction of travel, whereby the leading end of the carrying grip is secured to the container. Subsequently, the rotary plate carries out a rotation through 180 degrees, with the container simultaneously moving by a defined distance so that, as the rotary movement finds its conclusion, the second end of the rotary plate contacts the back side of the container. By way of this contact, the end of the carrying grip is attached on the back side of the container, at the same time, the cutting tool that is disposed in the rotary plate severs the carrying grip from the endless plastic strip. It is of disadvantage in such an arrangement that realization of the non-uniform rotational movement of the rotary plate requires a high degree of control engineering effort, whereby, due to the required high angular accelerations, high drive efforts also need to be provided. Again, in this arrangement, the length of the carrying grip is determined by the geometric configuration of the arrangement, such that an adaptation to changed container dimensions can be done only by way of exchanging the rotary plate and with considerable attendant adjustment work being required as well. German Patent No. 693 00 175 and its corresponding European Patent No. EP 0 560 699 published on Sep. 15, 1993 are hereby incorporated by reference as if set forth in their entirety herein.

The design principle described in the foregoing is essentially followed by the arrangement described in German Patent No. DE 693 08 878, published on Aug. 8, 1997, such that the disadvantages described above also apply to the arrangement that corresponds to the disclosure of German Patent No. 693 08 878. German Patent No. 693 08 878 and its corresponding U.S. Pat. No. 5,458,726 issued to Castoldi on Oct. 17, 1995 are hereby incorporated by reference as if set forth in their entirety herein.

In all of the above-described systems it is additionally of detriment that a change in the size of the container would generally entail a laborious adjustment of the operating height of the system.

There furthermore resides a detriment in that in known systems there is a requirement for a comparatively large separation between the individual containers, which causes high conveying velocities. To achieve a ramp-up of the speed and a subsequent deceleration of such high conveying velocities entails voluminous mechanical measures.

OBJECT

One object of an embodiment is believed at the time of the filing of this patent application to possibly reside broadly in the provision of an apparatus that avoids the above-mentioned drawbacks and in a simple manner and that is adaptable to various container dimensions.

SUMMARY

One feature or aspect of an embodiment is believed at the time of the filing of this patent application to possibly reside broadly in an applicator device with an X-Y-positioning unit that is based on flexible pulling elements, such as, for example, toothed or lugged belts.

Another feature or aspect of an embodiment is believed at the time of the filing of this patent application to possibly reside broadly in a beverage bottling plant for filling bottles with a liquid beverage filling material, said beverage bottling plant comprising: a cleaning station being configured and disposed to clean bottles; a first conveyer arrangement being configured and disposed to convey bottles to said cleaning station; an inspection station being configured and disposed to inspect cleaned bottles; said inspection station comprising at least a first inspection structure and a second inspection structure separate from said first inspection structure; a second conveyer arrangement being configured and disposed to convey cleaned bottles from said cleaning station to said inspection station; a filling machine being configured to fill cleaned and inspected bottles with liquid beverage filling material; said beverage filling machine comprising a plurality of beverage filling positions, each beverage filling position comprising a beverage filling device for filling bottles with liquid beverage filling material; said filling devices comprising apparatus being configured to introduce a predetermined flow of liquid beverage filling material into the interior of bottles to a substantially predetermined level of liquid beverage filling material; said apparatus being configured to introduce a predetermined flow of liquid beverage filling material comprising apparatus being configured to terminate the filling of beverage bottles upon liquid beverage filling material reaching said substantially predetermined level in bottles; a third conveyer arrangement being configured and disposed to move inspected bottles from said inspection machine to said filling machine; a closing station being configured to close filled bottles; a fourth conveyer arrangement being configured and disposed to transfer filled bottles from said filling machine to said closing station; a packaging station being configured to package a plurality of bottles into single containers; a fifth conveyor arrangement being configured and disposed to transfer closed, filled bottles from said closing station to said packaging station; a handle-attaching station being configured and disposed to attach carrying handles to said containers; a sixth conveyor arrangement being configured and disposed to transfer said containers to and through said handle-attaching station; said handle-attaching station comprising an attaching mechanism to attach said carrying handles to said containers; said attaching mechanism comprising an applicator head configured and disposed to dispense and attach strips of material to said containers to form said carrying handles; said attaching mechanism comprising an X-Y-positioning unit; said applicator head being connected to and disposed at an end of said X-Y-positioning unit to permit said applicator head to contact said containers to attach said carrying handles; said X-Y-positioning unit being configured and disposed to move said applicator head about said containers to permit said applicator head to attach a first end of said carrying handles to a first surface of said containers and to attach a second end of said carrying handles to a second surface of said containers; and a computer control device being configured and disposed to control the movement of said X-Y-positioning unit according to a movement program.

Yet another feature or aspect of an embodiment is believed at the time of the filing of this patent application to possibly reside broadly in a method of operating a beverage bottling plant for filling bottles with a liquid beverage filling material, said beverage bottling plant comprising: a cleaning station being configured and disposed to clean bottles; a first conveyer arrangement being configured and disposed to convey bottles to said cleaning station; an inspection station being configured and disposed to inspect cleaned bottles; said inspection station comprising at least a first inspection structure and a second inspection structure separate from said first inspection structure; a second conveyer arrangement being configured and disposed to convey cleaned bottles from said cleaning station to said inspection station; a filling machine being configured to fill cleaned and inspected bottles with liquid beverage filling material; said beverage filling machine comprising a plurality of beverage filling positions, each beverage filling position comprising a beverage filling device for filling bottles with liquid beverage filling material; said filling devices comprising apparatus being configured to introduce a predetermined flow of liquid beverage filling material into the interior of bottles to a substantially predetermined level of liquid beverage filling material; said apparatus being configured to introduce a predetermined flow of liquid beverage filling material comprising apparatus being configured to terminate the filling of beverage bottles upon liquid beverage filling material reaching said substantially predetermined level in bottles; a third conveyer arrangement being configured and disposed to move inspected bottles from said inspection machine to said filling machine; a closing station being configured to close filled bottles; a fourth conveyer arrangement being configured and disposed to transfer filled bottles from said filling machine to said closing station; a packaging station being configured to package a plurality of bottles into single containers; a fifth conveyor arrangement being configured and disposed to transfer closed, filled bottles from said closing station to said packaging station; a handle-attaching station being configured and disposed to attach carrying handles to said containers; a sixth conveyor arrangement being configured and disposed to transfer said containers to and through said handle-attaching station; said handle-attaching station comprising an attaching mechanism to attach said carrying handles to said containers; said attaching mechanism comprising an applicator head configured and disposed to dispense and attach strips of material to said containers to form said carrying handles; said attaching mechanism comprising an X-Y-positioning unit; said applicator head being connected to and disposed at an end of said X-Y-positioning unit to permit said applicator head to contact said containers to attach said carrying handles; said X-Y-positioning unit being configured and disposed to move said applicator head about said containers to permit said applicator head to attach a first end of said carrying handles to a first surface of said containers and to attach a second end of said carrying handles to a second surface of said containers; and a computer control device being configured and disposed to control the movement of said X-Y-positioning unit according to a movement program, said method comprising the steps of: transporting said bottles with said first conveyer arrangement to said cleaning station; cleaning said bottles at said cleaning station; transporting said bottles with said second conveyer arrangement from said cleaning station to said inspection station; inspecting said bottles at said inspection station; transporting said bottles with said third conveyer arrangement from said inspection station to said filling machine; filling said bottles with said filling machine with liquid beverage filling material; transporting said bottles with said fourth conveyer arrangement from said filling machine to said closing station; closing said bottles at said closing station; transporting said bottles with said fifth conveyer arrangement from said closing station to said packaging station; packaging pluralities of bottles into containers at said packaging station; transporting said containers with said sixth conveyer arrangement from said packaging station to said handle-attaching station; and attaching carrying handles to said containers with said attaching mechanism; and said step of attaching carrying handles comprising the steps of: moving said applicator head with said X-Y-positioning unit adjacent a first side of a first container; attaching a first end of a carrying handle to said first side of said first container; moving said applicator head with said X-Y-positioning unit above an upper side of said first container and to a second side of said first container opposite said first side, wherein the length of said carrying handle is determined by the distance that said applicator head is positioned away from said upper side of said first container; moving said applicator head with said X-Y-positioning unit into a space between said first container and a second, successive, adjacent container; attaching a second end of said carrying handle to said second side of said first container; and repeating said steps for said second container and each successive container to attach carrying handles to said containers.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The embodiments are explained in greater detail below with reference to the accompanying drawings.

DESCRIPTION OF EMBODIMENTS

Figure 1:
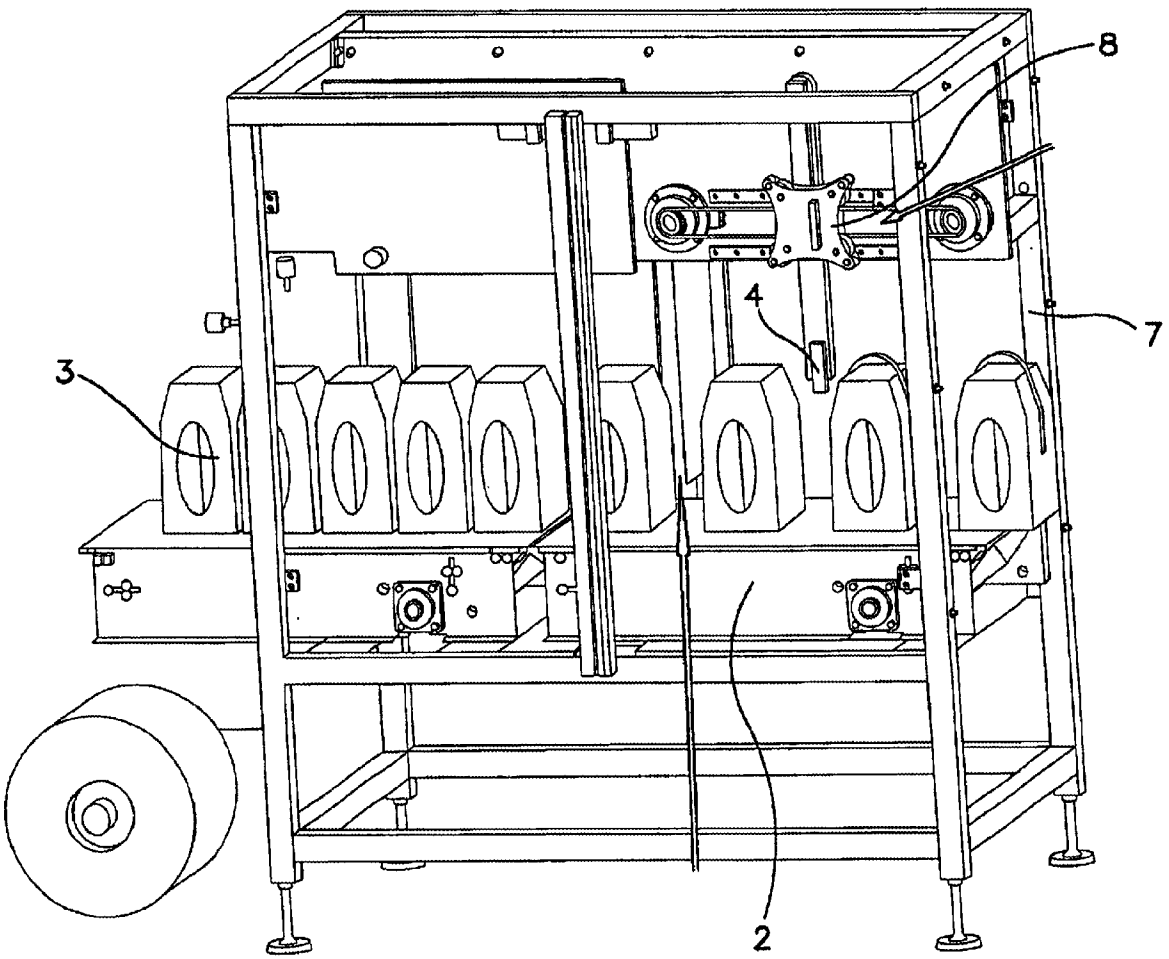
FIG. 1 shows in a simplified 3-D illustration an entire apparatus for the attaching of carrying grips.

Further development details, advantages and possibilities of application of the invention can be obtained from the following description of embodiments and the drawing. With this, all described and/or illustrated features per se or in any combination, comprise the substance of the invention, regardless of their combination in the claims or their dependency. At the same time, the content of the claims is made a component of the description.

Figure 1A:
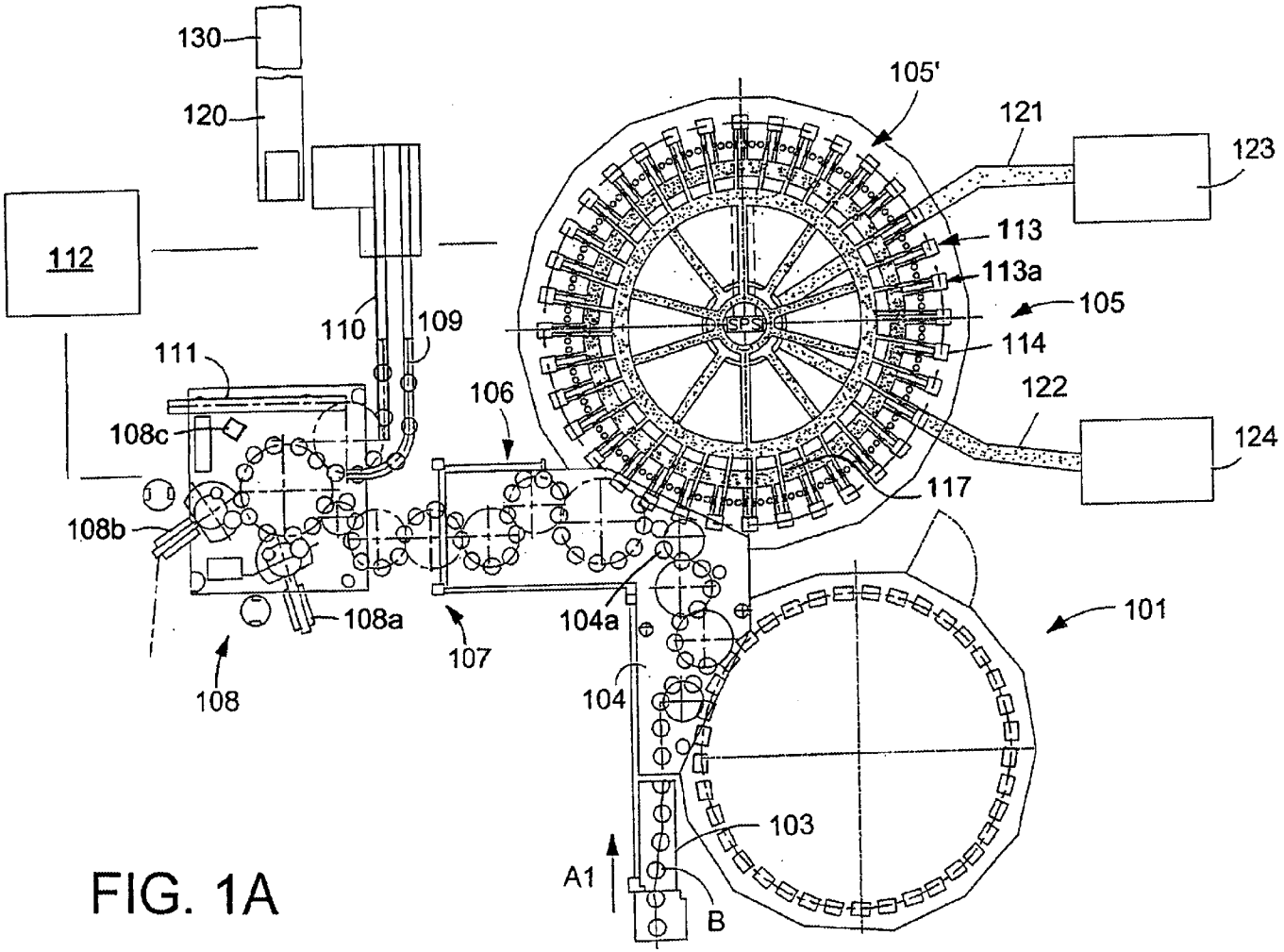
FIG. 1A is a schematic illustration of a container filling plant in accordance with one embodiment of the present application.
Figure 2:
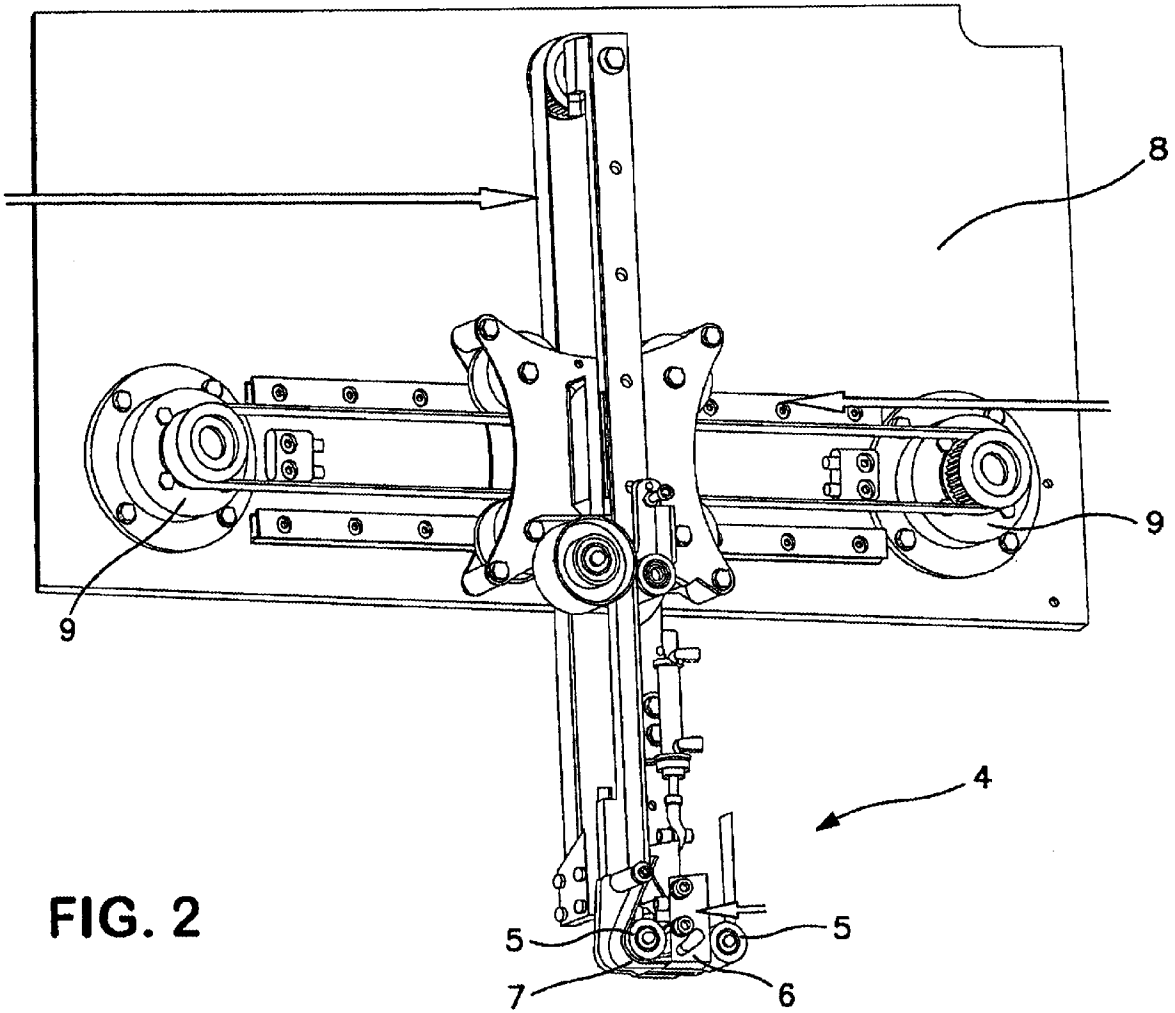
FIG. 2 shows a detail of an apparatus with an X-Y-positioning unit and an applicator head.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several aspects, of the embodiments disclosed herein.

FIG. 1A shows a rinser or rinser station 101, to which the containers, namely bottles B, are fed in the direction of travel as is indicated by the arrow A, by means of a conveyer line or conveyer arrangement 103, and downstream of rinser station 101, in the direction of travel as is indicated by the arrow A, the rinsed bottles B are transported to a beverage filling machine 105 by means of a conveyer line or conveyer arrangement 104 that is formed, for example, by a star wheel conveyer or a plurality of star wheels of a conveyer arrangement. The conveyer arrangement 104 may possibly have a star wheel 104*a* that introduces bottles B to the filling machine 105.

Downstream of the filling machine 105, in the direction of travel of the bottles B, there can preferably be a closer or closer station 106 which closes the bottles B.

The closer or closer station 106 can, for example, be connected directly to a labeling device or labeling station 108, such as, for example, by means of a conveyer line or conveyer arrangement 107 that may be formed, for example, by a plurality of star wheels of a conveyer arrangement.

In the illustrated embodiment, the labeling device or labeling machine or labeling station 108 has, for example, three outputs, namely one output formed by a conveyer or conveyer arrangement 109 for bottles B that are filled with a first product. The first product may possibly be provided by a product mixer 123 that is connected to the filling machine 105, for example, through a conduit 121, and bottles B that are filled with a predetermined volume of liquid beverage filling material, that is, the first product, are then labeled by a labeling module 108*a* in the labeling stations 108 corresponding to this first product delivered from product mixer 123 to the beverage filling machine 105 and thence to the corresponding bottles B.

A second output that is formed by a conveyer or conveyer arrangement 110 is provided for those bottles B that are filled with a second product. The second product may emanate from a second product mixer 124 that is connected, for example, through a conduit 122 to the filling machine 105, and these bottles B filled with a predetermined volume of liquid beverage filling material comprising the second product are then correspondingly labeled by a labeling module 108*b* in the labeling station 108 corresponding to this second product.

A third output, for example, formed by a conveyer or conveyer arrangement 111, removes any bottles B which have been incorrectly labeled as may have been determined by an inspecting device or an inspecting station, or an inspecting module 108*c* that may possibly form a part of the labeling station 108.

At the outputs of the conveyers 109 and 110 there may possibly be provided a containerization station 120 that gathers filled bottles into cartons as six-pack units, for example.

There may also be provided a station 130 that attaches handles of handgrips to six-pack units as will be described in greater detail below.

In FIG. 1A item 112 is a central control unit or, expressed differently, a controller or a system which includes a process controller that, among other things, controls the operation of the above-referenced system or plant.

The beverage filling machine 105 is preferably of the revolving design, with a rotor 105', which revolves around a vertical machine axis. On the periphery of the rotor 105' there are a number of filling positions 113, each of which comprises bottle carriers or container carriers 113*a* that are configured and disposed to present bottles B for filling, as well as a filling device or element or apparatus 114 located or configured to be located above the corresponding container carrier 113*a* and the corresponding bottle B presented by the carrier 113*a*. The filling device or apparatus 114 comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, filling elements 114 are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of an external connecting line 121 to the external reservoir or product mixer 123 to supply the product, that is, product mix 1, for example.

As well as the more typical filling machines having one toroidal vessel, it is possible that in at least one possible embodiment a filling machine could possibly be utilized wherein each filling device 114 is preferably connected by means of two connections to a toroidal vessel 117 which contains a first product, say by means of a first connection, for example, 121, and to a second toroidal vessel which contains a second product, say by means of the second connection, for example, 122. In this case, each filling device 114 can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

As is illustrated in FIG. 1, the dispenser for carrying grips comprises firstly a base frame structure 1. Containers that are to be equipped with a carrying grip are conveyed by a belt conveyer that is known in the art, whereby the containers are initially conveyed in a closed formation, that is without a gap between the individual containers. Upon transfer to a second conveyer 2, that operates at a higher conveyer belt velocity, the containers are disposed at a distance with respect to one another on the second conveyer 2.

An X-Y-positioning unit that is based on flexible pulling elements is disposed vertically above the containers 3 at a lateral wall of the base frame structure 1, and the X-Y-positioning unit carries an applicator head 4 at its lowermost end of the y-axis.

Such X-Y-positioning units that are based on the utilization of flexible pulling elements, such as, for example, toothed belts, are known for some time. A particular advantage of such systems is the fact that the two required drive motors can be disposed in a fixed manner, which considerably reduces the masses that need to be moved, this permitting a particularly advantageous design and execution thereof. As well, the driving power of the motors can be markedly reduced because all movements carried out by the positioning unit are simultaneously powered by the two motors, due to the particular design of the two motors.

The movements in the x-direction and/or in the y-direction that need to be realized are somewhat different when compared to those of standard X-Y-positioning units and such movements have been exhaustively described and illustrated in German Laid Open Patent Application No. DE 100 17 041, published on Oct. 18, 2001, so that another description herein is superfluous. German Laid Open Patent Application No. 100 17 041 is hereby incorporated by reference as if set forth in its entirety herein.

The applicator head 4 comprises firstly two presser rollers 5, a cutting arrangement 6, and a gripper device 7.

The plastic strip is passed to the applicator head 4 by way of an in-feed device, not shown, from a storage for the strip, and a roller that has a return stop system. The plastic strip is initially held by a gripper device 7 at the applicator head. The gripper device 7 may be a vacuum gripper, a mechanical gripper, an electrostatic gripper, or a grippers that operates in another known manner.

At the commencement of each operating cycle, the applicator head 4 is positioned in the gap between two containers. By way of a sensor, that is disposed in upstream direction of the flow of containers at the side of the stream of the containers, an indication is given that the forward edge of the succeeding container has reached a defined position, which leads to starting of the operating cycle.

In a further embodiment, provision is made that the above-described sensor is replaced by a sensor that is disposed at the applicator head 4. Such a sensor may possibly be a contact sensor that functions upon a direct physical contact with the succeeding container. However, use can also be made of a proximity switch that functions when the succeeding container is a defined distance away from the proximity switch.

The applicator head 4 initially contacts the forward side of the container and there attaches the leading end of the carrying grip to the container. Subsequently, the applicator head is moved in the conveying direction of the containers 3 and simultaneously in upward direction, this pressing the remaining surface of the first adhesive strip to the wall of the container.

Upon the lower edge of the applicator head 4 having been raised to above the height of the container 3, the X-Y-positioning unit moves in the direction opposite to the direction in which the containers 3 are traveling with the conveyer. By way of this distance of travel that embraces additionally a displacement distance to a point located above the container, the length of the gripping portion of the carrying grip is determined as desired. The length of the carrying loop may also be determined in such a way that the applicator head 4 moves for a defined distance beyond the rearward edge of the container, with a combination of the two procedures being possible.

Upon the applicator head 4 having reached a position vertically above the rearward edge of the container 3, the applicator head follows the horizontal movement of the container 3, initially touches the upper rearward edge of the container 3 and attaches at this location the leading portion of the second adhesive strip or portion. To fully attach the carrying grip, the applicator head 4 further follows the horizontal movement of the container 3 and simultaneously moves in the direction of the bottom of the container 3, this resulting in a secure attaching of the remaining length of the second adhesive strip to the container 3.

Upon the applicator head 4 reaching, during its downward movement, a point approximately 35 millimeters above the lowermost position, the cutting arrangement 6 cuts the plastic band, and the applicator head 4 presses the end that has been loose up to this point in time to the container 3. In other possible embodiments, the applicator head 4 can be moved downwardly to a point greater than 35 millimeters or less than 35 millimeters above the lowermost portion depending on the dimensions of the container and the desired position and dimensions of the carrying grip.

Subsequently, the applicator head returns into the starting position of the operating cycle, this return movement completing one operating cycle.

An essential advantage of the present invention resides therein that the movements of the X-Y-positioning unit 8, and, consequently, the movements of the applicator head 4, can be adapted by changing the programmed movements in a simple manner to permit accommodation of changed dimensions of a container or to attend to the wishes pertaining to the configuration of the carrying grip.

This is attained thereby that the drive motors 9 of the X-Y-positioning unit 8 are configured as servo-drives. This means that each drive motor 9 is equipped with a control arrangement for the desired number of revolutions that are to be carried out, and also, aside from the absolute angle of rotation, also further parameters, such as, for example, direction of rotation, rotational velocity, angular acceleration and retardation of angular velocity are preset.

Each motor additionally has a control arrangement, for example, an absolute value rotary position transducer that determines the actually completed rotational movements and passes this data to the control arrangement. Within the control arrangement, the actual-values received by the motors are continuously compared with the set-values, and any necessary corrections are carried out.

For realization of these functions, many avenues of solutions have become known and a further description of the topic 'servo drives' can be omitted here.

A further substantial advantage of the present invention resides therein that a change in the size of the container does not require an adjustment of the relative height of elements and equipment units.

Furthermore, substantial advantages reside therein that a system in accordance with the invention requires only a small gap between the individual containers. In practical use it has been determined that a gap of 120 millimeters is sufficient. Known systems however require gaps of at least 190 millimeters.

For a further embodiment it is provided that the applicator head 4 has at least one spray device for spraying liquid or hot-liquid adhesives. In such an embodiment, the utilization of self-adhesive carrying grip starting materials is obviated, which leads to the following advantages: utilization of an economical starting material and an increase of the storage capacity of the material of the strip since the paper strip that covers the two adhesive portions is made superfluous.

The configuration of the spray device may be in accordance of two variants. In a first variant, two spray devices are used, whereby these are arranged at the applicator head 4 such that one spray device is spraying adhesive on the forward side of a container 3 and the other spray device is spraying adhesive on the rearward side of the container 3, this allowing attaching of the leading end portion and of the trailing end portion of the carrying grip to the container 3. In the case of a second variant, only one spray device is utilized, that, however, can be swung about an axis such that such single spray device can also spray adhesive on the forward side and onto the rearward side of the container 3. In this it is of particular advantage when the swinging movement is produced by a motor that is controlled by the control arrangement mentioned in the foregoing, and the choice of the type of motor is not of importance.

In a further highly advantageous configuration or embodiment, provision is made that in the region of the second conveyer 2 at least two further conveyer belts are disposed, these being equipped in such a way that their running surfaces are in frictional contact with one lateral surface of the containers 3. This will safely prevent that the forwardly directed lower edges of the containers 3 are not lifted during upwardly directed movement of the applicator head 4 upon securing of the leading end of the carrying grip.

One feature or aspect of an embodiment is believed at the time of the filing of this patent application to possibly reside broadly in an apparatus for attaching carrying grips of any desired material at containers of any desired type, characterized in that an applicator head 4 is disposed at an X-Y-positioning unit 8.

Another feature or aspect of an embodiment is believed at the time of the filing of this patent application to possibly reside broadly in the apparatus characterized in that the applicator head 4 can be moved by the X-Y-positioning unit 8 downwardly into and out of the space between containers 3 that can be spaced apart from one another.

Yet another feature or aspect of an embodiment is believed at the time of the filing of this patent application to possibly reside broadly in the apparatus characterized in that the X-Y-positioning unit is a device that utilizes flexible pulling elements.

Still another feature or aspect of an embodiment is believed at the time of the filing of this patent application to possibly reside broadly in the apparatus characterized in that the applicator head 4 comprises a sensor that senses the distance of the succeeding container 3.

A further feature or aspect of an embodiment is believed at the time of the filing of this patent application to possibly reside broadly in the apparatus characterized in that the applicator head 4 comprises at least one device for applying liquid adhesives or hot-liquid adhesives.

Another feature or aspect of an embodiment is believed at the time of the filing of this patent application to possibly reside broadly in the apparatus characterized in that the device for applying liquid or hot-liquid adhesives is configured to be swung about at least one axis by way of a drive arrangement having a control arrangement.

Yet another feature or aspect of an embodiment is believed at the time of the filing of this patent application to possibly reside broadly in the apparatus characterized in that the applicator head 4 comprises a cutting arrangement 6.

Still another feature or aspect of an embodiment is believed at the time of the filing of this patent application to possibly reside broadly in the apparatus characterized in that the applicator head 4 comprises a gripper device 7.

A further feature or aspect of an embodiment is believed at the time of the filing of this patent application to possibly reside broadly in the apparatus characterized in that the gap between two containers that are being processed is less than 180 mm.

Another feature or aspect of an embodiment is believed at the time of the filing of this patent application to possibly reside broadly in the method of attaching carrying grips of any desired material at containers of any desired type, characterized in that an applicator head moves into the space between two containers 3, attaches the carrying grip at the first side of the container, moves above the upper side of the container to the back side thereof, whereby the length of the carrying grip is determined by the distance that the applicator head 4 is away from the upper side of the container, and subsequently attaches the carrying grip at the back side of the container 3.

Yet another feature or aspect of an embodiment is believed at the time of the filing of this patent application to possibly reside broadly in the method characterized in that the required quantity of adhesive for attaching the carrying grip is applied by at least one adhesive spray dispenser that is disposed at the applicator head 4.

The components disclosed in the various publications, disclosed or incorporated by reference herein, may possibly be used in possible embodiments of the present invention, as well as equivalents thereof.

Some examples of devices for attaching carrying handles or carrying strips to containers and components thereof that may possibly be utilized or possibly adapted for use in at least one possible embodiment of the present application may possibly be found in the following U.S. Pat. No. 3,557,516 issued January, 1971 to Brandt; U.S. Pat. No. 4,415,399 issued November, 1983 to Geisinger; U.S. Pat. No. 4,477,304 issued October, 1984 to Westermann;. U.S. Pat. No. 4,640,731 issued Febuary, 1987 to Lerner et al.; U.S. Pat. No. 4,683,017 issued July, 1987 to Figiel et al.; U.S. Pat. No. 4,700,528 issued October, 1987 to Bernard; U.S. Pat. No. 4,758,301 issued July, 1987 to Inoko et al.; U.S. Pat. No. 4,830,895 issued May., 1989 to Bernard; U.S. Pat. No. 4,889,581 issued December, 1989 to Ulrich et al.; U.S. Pat. No. 4,906,319 issued March, 1990 to Fiorani; U.S. Pat. No. 4,936,945 issued June, 1990 to Marchetti; U.S. Pat. No. 5,052,165 issued October, 1991 to Gunther; and U.S. Pat. No. 5,079,900 issued January, 1992 to Pinckney et al.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No.

6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of X-Y-drive arrangements that may possibly be utilized or possibly adapted for use in at least one possible embodiment of the present application may possibly be found in the following U.S. Pat. No. 5,216,932 issued to Takei on Jun. 8, 1993; German Laid Open Patent Application No. 43 38 155 naming Matthias Arndt as inventor and published on May 4, 1995; German Laid Open Patent Application No. 100 17 293 naming Matthias Arndt as inventor and published on Nov. 8, 2001; and German Utility Model No. 203 05 362 U1 published on Jul. 10, 2003.

The appended drawings in their entirety, including all dimensions, proportions and/or shapes in at least one embodiment of the invention, are accurate and are hereby included by reference into this specification.

Some examples of flexible pulling elements that may possibly be utilized or possibly adapted for use in at least one possible embodiment of the present application may possibly be found in the following U.S. Pat. No. 4,993,997 issued to Stuhler on Feb. 19, 1991; U.S. Pat. No. 5,741,198 issued to Fujiwara et al. on Apr. 21, 1998; U.S. Pat. No. 5,904,466 issued to Miller et al. on May 18, 1999; U.S. Pat. No. 6,159,121 issued to Di Giacomo et al. on Dec. 12, 2000; U.S. Pat. No. 6,485,384 issued to Ochiai et al. on Nov. 26, 2002; and U.S. Pat. No. 6,575,862 issued to Miyaji on Jun. 10, 2003.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of distance sensors that may possibly be utilized or possibly adapted for use in at least one possible embodiment of the present application may possibly be found in the following U.S. Pat. No. 5,412,327 issued to Meinen on May 2, 1995; U.S. Pat. No. 5,500,728 issued to Nishimoto on Mar. 19, 1996; U.S. Pat. No. 5,781,269 issued to Ito et al. on Jul. 14, 1998; U.S. Pat. No. 6,320,394 issued to Tartagni on Nov. 20, 2001; U.S. Pat. No. 6,480,008 issued to Okamoto et al. on Nov. 12, 2002; and U.S. Pat. No. 6,650,401 issued to Oka on Nov. 18, 2003.

All, or substantially all, of the components and methods of the various embodiments may be used with at least one embodiment or all of the embodiments, if more than one embodiment is described herein.

Some examples of adhesive applicators that may possibly be utilized or possibly adapted for use in at least one possible embodiment of the present application may possibly be found in the following U.S. Pat. No. 5,700,322 issued to Fort on Dec. 23, 1997 U.S. Pat. No. 5,862,986 issued to Bolyard, Jr. et al. on Jan. 26, 1999; U.S. Pat. No. 6,076,711 issued to McGuffey on Jun. 20, 2000; U.S. Pat. No. 6,168,049 issued to Bollard, Jr. on Jan. 2, 2001; U.S. Pat. No. 6,499,631 issued to Zook on Dec. 31, 2002; and U.S. Pat. No. 6,592,281 issued to Clark et al. on Jul. 15, 2003.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of hot melt adhesives that may possibly be utilized or possibly adapted for use in at least one possible embodiment of the present application may possibly be found in the following U.S. Pat. No. 5,994,347 issued to Lebez et al. on Nov. 30, 1999; U.S. Pat. No. 6,034,168 issued to Wang on Mar. 7, 2000; U.S. Pat. No. 6,218,457 issued to Fralich et al. on Apr. 17, 2001; U.S. Pat. No. 6,579,406 issued to Brink man on Jun. 17, 2003; U.S. Pat. No. 6,607,104 issued to McGuffey on Aug. 19, 2003; and U.S. Pat. No. 6,688,498 issued to McGuffey on Feb. 10, 2004.

All of the patents, patent applications and publications recited herein, and in the Declaration attached hereto, are hereby incorporated by reference as if set forth in their entirety herein.

Some examples of servo drive arrangements that may possibly be utilized or possibly adapted for use in at least one possible embodiment of the present application may possibly be found in the following U.S. Pat. No. 4,072,884 issued to Treadwell on Feb. 7, 1978; U.S. Pat. No. 4,565,956 issued to Zimmermann et al. on Jan. 21, 1986; U.S. Pat. No. 4,598,598 issued to Kring et al. on Jul. 8, 1986; U.S. Pat. No. 4,918,365 issued to Tanuma et al. on Apr. 17, 1990; U.S. Pat. No. 5,635,809 issued to Ganser et al. on Jun. 3, 1997; and U.S. Pat. No. 6,278,252 issued to Kachouh on Aug. 21, 2001.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of motor control arrangements that may possibly be utilized or possibly adapted for use in at least one possible embodiment of the present application may possibly be found in the following U.S. Pat. No. 5,399,953 issued to Yoshio on Mar. 21, 1995; U.S. Pat. No. 5,694,010 issued to Oomura et al. on Dec. 2, 1997; U.S. Pat. No. 5,739,650 issued to Kumura et al. on Apr. 14, 1998; U.S. Pat. No. 6,157,151 issued to Yoshitomi et al. on Dec. 5, 2000; U.S. Pat. No. 6,563,283 issued to Iwashita et al. on May 13, 2003; and U.S. Pat. No. 6,583,593 issued to Iijima et al. on Jun. 24, 2003.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of microprocessors that may possibly be utilized or possibly adapted for use in at least one possible embodiment of the present application may possibly be found in the following U.S. Pat. No. 6,095,987 issued to Shmulewitz et al. on Aug. 1, 2000; U.S. Pat. No. 6,516,331 issued to Beiu on Feb. 4, 2003; U.S. Pat. No. 6,522,981 issued to Smit et al. on Feb. 18, 2003; U.S. Pat. No. 6,539,502 issued to Davidson et al. on Mar. 25, 2003; U.S. Pat. No. 6,553,460 issued to Chopra et al. on Apr. 22, 2003; U.S. Pat. No. 6,557,098 issued to Oberman et al. on Apr. 29, 2003; U.S. Pat. No. 6,571,363 issued to Steiss on May 27, 2003; and U.S. Pat. No. 6,574,724 issued to Hoyle et al. on Jun. 3, 2003.

The corresponding foreign patent publication applications, namely, Federal Republic of Germany Patent Application No. 103 15 116.8 filed on Apr. 3, 2003, having inventors Tilo LECHNER and Ludger PAULS, and DE-OS 103 15 116, having inventors Tilo LECHNER and Ludger PAULS, and DE-PS 103 15 116, having inventors Tilo LECHNER and Ludger PAULS, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The co-pending U.S. patent application Ser. No. 10/756,171, filed on Jan. 13, 2004 having inventors Stefan WAGNER, Hans-Peter KUHLMANN, and Hans-Gerd RIPKENS, having the title "A beverage bottling plant for filling bottles and like containers with a liquid beverage filling material and a conveyer arrangement for aligning and distributing packages containing filled bottles and like containers," and its German priority patent application No. DE P 103 01 178.1, filed on Jan. 15, 2003, having inventors Stefan WAGNER, Hans-Peter KUHLMANN, and Hans-Gerd RIPKENS, and other equivalents or corresponding applications, if any, in corresponding cases in Germany and elsewhere, and the references and documents cited in any of the documents cited therein, such as the patents, patent applications and publications, are hereby incorporated by reference as if set forth in their entirety herein.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The co-pending U.S. patent application Ser. No. 10/723,451, filed on Nov. 26, 2003, having inventors Horst BOCKER, Berthold PAROTH, and Ulrich SCHOLZ, having the title "Beverage bottling plant for filling beverage bottles or other beverage containers with a liquid beverage filling material and an arrangement for dividing and separating of a stream of beverage bottles or other beverage containers," and its German priority patent application No. DE P 102 55 814.0, filed on Nov. 29, 2002, having inventors Horst BOCKER, Berthold PAROTH, and Ulrich SCHOLZ, and other equivalents or corresponding applications, if any, in corresponding cases in Germany and elsewhere, and the references and documents cited in any of the documents cited therein, such as the patents, patent applications and publications, are hereby incorporated by reference as if set forth in their entirety herein.

Some examples of rotary transducer arrangements that may possibly be utilized or possibly adapted for use in at least one possible embodiment of the present application may possibly be found in the following U.S. Pat. No. 5,271,348 issued to Cameron et al. on Dec. 21, 1993; U.S. Pat. No. 5,621,179 issued to Alexander on Apr. 15, 1997; U.S. Pat. No. 5,635,807 issued to Lautzenhiser on Jun. 3, 1997; U.S. Pat. No. 5,864,775 issued to Bradshaw et al. on Jan. 26, 1999; U.S. Pat. No. 5,905,350 issued to Hofbauer et al. on May 18, 1999; and U.S. Pat. No. 6,501,263 issued to Nyce on Dec. 31, 2002.

The details in the patents, patent applications and publications may be considered to be incorporable, at applicant's option, into the claims during prosecution as further limitations in the claims to patentably distinguish any amended claims from any applied prior art.

Some examples of cutting apparatus that may possibly be utilized or possibly adapted for use in at least one possible embodiment of the present application may possibly be found in the following U.S. Pat. No. 4,699,036 issued to Henne on Oct. 13, 1987; U.S. Pat. No. 5,033,343 issued to Gerber on Jul. 23, 1991; U.S. Pat. No. 6,131,498 issued to Gerber on Oct. 17, 2000; U.S. Pat. No. 6,647,844 issued to Nowaczyk on Nov. 18, 2003; U.S. Pat. No. 6,652,172 issued to Wood et al. on Nov. 25, 2003; and U.S. Pat. No. 6,698,488 issued to Ishinoda on Mar. 2, 2004.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of arrangements to swing a tool about a vertical axis that may possibly be utilized or possibly adapted for use in at least one possible embodiment of the present application may possibly be found in the following U.S. Pat. No. 4,087,129 issued to Maxey on May 2, 1978; U.S. Pat. No. 4,364,540 issued to Montabert on Dec. 21, 1982; U.S. Pat. No. 5,201,239 issued to Bundo et al. on Apr. 13, 1993; U.S. Pat. No. 5,279,177 issued to Inada on Jan. 18, 1994; U.S. Pat. No. 5,346,019 issued to Kinzenbaw et al. on Sep. 13, 1994; and U.S. Pat. No. 5,361 issued to McNabb on Nov. 8, 1994.

Some examples of vacuum grippers that may possibly be utilized or possibly adapted for use in at least one possible embodiment of the present application may possibly be found in the following U.S. Pat. No. 4,763,941 issued to Sniderman on Aug. 16, 1988; U.S. Pat. No. 4,775,290 issued to Brown et al. on Oct. 4, 1988; U.S. Pat. No. 5,374,091 issued to Gore et al. on Dec. 20, 1994; U.S. Pat. No. 6,382,692 issued to Schmalz et al. on May 7, 2002; U.S. Pat. No. 6,431,624 issued to Dunger on Aug. 13, 2002; and U.S. Pat. No. 6,502,877 issued to Schick et al. on Jan. 7, 2003.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Thus, one feature or aspect of an embodiment is believed at the time of the filing of this patent application to possibly reside broadly in an apparatus for the attaching of carrying grips of any desired material at containers of any desired type, and it is provided that an applicator head 4 is disposed at an X-Y-positioning arrangement 8.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of operating a beverage bottling plant for filling beverage bottles with a liquid beverage filling material, said beverage bottling plant comprising:

a cleaning station being configured and disposed to clean bottles;

a first conveyer arrangement being configured and disposed to convey bottles to said cleaning station;

an inspection station being configured and disposed to inspect cleaned bottles;

said inspection station comprising at least a first inspection structure and a second inspection structure separate from said first inspection structure;

a second conveyer arrangement being configured and disposed to convey cleaned bottles from said cleaning station to said inspection station;

a beverage filling machine being configured and disposed to fill cleaned and inspected bottles with liquid beverage filling material;

said beverage filling machine comprising a plurality of beverage filling devices for filling bottles with liquid beverage filling material to a substantially predetermined level;

a third conveyer arrangement being configured and disposed to move inspected bottles from said inspection machine to said beverage filling machine;

a closing station being configured and disposed to close filled bottles;

a fourth conveyer arrangement being configured and disposed to transfer filled bottles from said beverage filling machine to said closing station;

a packaging station being configured to package a plurality of bottles into individual carrying containers;

a fifth conveyor arrangement being configured and disposed to transfer closed, filled bottles from said closing station to said packaging station;

a handle-attaching station being configured and disposed to attach carrying handles to corresponding carrying containers;

a sixth conveyor arrangement being configured and disposed to transfer said carrying containers from said packaging station to said handle-attaching station and through said handle-attaching station;

said sixth conveyor arrangement being configured and disposed to space apart said carrying containers from one another upon said carrying containers entering said handle-attaching station;

said handle-attaching station comprising an attaching mechanism to attach said carrying handles to said carrying containers;

said attaching mechanism comprising an applicator head configured and disposed to dispense and attach strips of material to said carrying containers to form said carrying handles;

said attaching mechanism comprising an X-Y-positioning unit being configured to move said applicator head horizontally and vertically;

said applicator head being connected to and disposed at an end of said X-Y-positioning unit to permit said applicator head to contact said carrying containers to attach said carrying handles;

said X-Y-positioning unit being configured and disposed to move said applicator head about each of said carrying containers to permit said applicator head to attach a first end of each of said carrying handles to a first surface of each corresponding one of said carrying containers and to attach a second end of each of said carrying handles to a second surface of each corresponding one of said carrying containers; and a computer control device being configured and disposed to control the movement of said X-Y-positioning unit according to a movement program;

said method comprising the steps of:

A) conveying with said first conveyer arrangement bottles to said cleaning station;

B) cleaning with said cleaning station bottles;

C) conveying with said second conveyer arrangement cleaned bottles from said cleaning station to said inspection station;

D) inspecting with said inspection station cleaned bottles;

E) conveying with said third conveyer arrangement inspected bottles from said inspection station to said filling machine;

F) filling with said filling machine cleaned and inspected bottles with liquid beverage filling material to a substantially predetermined level of liquid beverage filling material;

G) conveying with said fourth conveyer arrangement filled bottles from said filling machine to said closing station;

H) closing with said closing station filled bottles;

I) conveying with said fifth conveyor arrangement closed bottles from said closing station to said packaging station;

J) packaging with said packaging station closed bottles into a first set of carrying containers;

K) conveying with said sixth conveyor arrangement said first set of carrying containers from said packaging station to said handle attaching station and through said handle-attaching station;

L) spacing apart with said sixth conveyor arrangement successive carrying containers of said first set of carrying containers upon said first set of carrying containers entering said handle attaching station;

M) dispensing and attaching with said applicator head strips of material to each of said first set of carrying containers to form carrying handles, said step of dispensing and attaching comprising:

N) moving said applicator head in front of a first carrying container of said first set of carrying containers;

O) contacting with said applicator head said first surface of said first carrying container and attaching a first end of the carrying handle to the first surface of said first carrying container;

P) moving said applicator head a predetermined distance above the upper side of said first carrying container to form a carrying handle;

Q) determining the length of said carrying handle by the distance that said applicator head is away from an upper side of said first carrying container;

R) moving said applicator head into the space between said first carrying container and a subsequent, second carrying container of said first set of carrying containers;

S) contacting with said applicator head said second surface of said first carrying container and attaching said second end of said carrying handle to said second surface of said first carrying container;

T) controlling with said computer control device the movement and actions of said X-Y-positioning unit according to a first movement program to control the movement of said applicator head; and U) repeating steps N) to T) for said subsequent, second carrying container and each subsequent carrying container of said first set of carrying containers;

said method further comprising:

programming said computer control device with a plurality of movement programs for carrying containers having different size configurations and for carrying handles having different size configurations;

packaging a second set of carrying containers wherein each carrying container has a size configuration different from said carrying containers of said first set of carrying containers;

choosing an additional different movement program on said computer control device different from said first movement program, which different movement program is configured to attach carrying handles formed from a different length of strips of material to said second set of carrying containers;

repeating steps K) to U) with the different movement program on said second set of carrying containers and additional sets of carrying containers.

2. The method of operating a beverage bottling plant according to claim 1, comprising at least one of (i), (ii), (iii), (iv), (v), and (vi):

(i) said method further comprises the step of moving said applicator head downwardly into and upwardly out of the space between each of said carrying containers by said X-Y-positioning unit downwardly into and upwardly out of the space between each of said carrying containers to permit attachment of said carrying handles;

(ii) said X-Y-positioning unit comprises at least one flexible pulling element;

(iii) said applicator head comprises a sensor configured to sense the distance away of an approaching carrying container, said method further comprises the step of sensing with said sensor in said applicator head the distance away of an approaching carrying container;

(iv) said applicator head comprises at least one spray device configured to spray liquid adhesive or hot liquid adhesive on said carrying containers to permit attachment of carrying handles, said method further comprises the steps of:

spraying one of liquid adhesive and hot-liquid adhesive with said at least one spray device of said applicator head on said carrying containers to permit attachment of carrying handles; and swinging said at least one spray device about at least one axis by way of a drive arrangement;

(v) said step of dispensing and attaching with said applicator head strips of material to each of said first set of carrying containers to form carrying handles further comprises the step of cutting with a cutting arrangement said strips of material; and (vi) said applicator head comprises a gripper device to grip said carrying handles, said method further comprises the steps of:

gripping with said gripper device said carrying handles for attachment on said carrying containers; and spacing adjacent carrying containers on said sixth conveyer arrangement upon movement through said handle-attaching station at less than 180 mm.

3. The method of operating a beverage bottling plant according to claim 1, comprising all of (i), (ii), (iii), (iv), (v), and (vi):

(i) said method further comprises the step of moving said applicator head downwardly into and upwardly out of the space between each of said carrying containers by said X-Y-positioning unit downwardly into and upwardly out of the space between each of said carrying containers to permit attachment of said carrying handles;

(ii) said X-Y positioning unit comprises at least one flexible pulling element;

(iii) said applicator head comprises a sensor configured to sense the distance away of an approaching carrying container, said method further comprises the step of sensing with said sensor in said applicator head the distance away of an approaching carrying container;

(iv) said applicator head comprises at least one spray device configured to spray liquid adhesive or hot liquid adhesive on said carrying containers to permit attachment of carrying handles, said method further comprises the steps of:

spraying one of liquid adhesive and hot-liquid adhesive with said at least one spray device of said applicator head on said carrying containers to permit attachment of carrying handles; and swinging said at least one spray device about at least one axis by way of a drive arrangement;

(v) said step of dispensing and attaching with said applicator head strips of material to each of said first set of carrying containers to form carrying handles further comprises the step of cutting with a cutting arrangement said strips of material; and (vi) said applicator head comprises a gripper device to grip said carrying handles, said method further comprises the steps of:

gripping with said gripper device said carrying handles for attachment on said carrying containers; and spacing adjacent carrying containers on said sixth conveyer arrangement upon movement through said handle-attaching station at less than 180 mm.

4. A method of operating a beverage container filling plant for filling beverage containers, such as bottles and cans, with a liquid beverage filling material, said beverage container filling plant comprising:

a packaging station being configured to package a plurality of containers into individual carrying containers;

a first conveyor arrangement being configured and disposed to transfer closed filled beverage containers to said packaging station from a container closing station;

a handle-attaching station being configured and disposed to attach carrying handles to corresponding carrying containers;

a second conveyor arrangement being configured and disposed to transfer said carrying containers from said packaging station to said handle-attaching station and through said handle-attaching station;

said handle-attaching station comprising an attaching mechanism to attach said carrying handles to said carrying containers;

said attaching mechanism comprising an applicator head configured and disposed to dispense and attach strips of material to said carrying containers to form said carrying handles;

said attaching mechanism comprising an X-Y-positioning unit being configured to move said applicator head horizontally and vertically;

said applicator head being connected to and disposed at an end of said X-Y-positioning unit to permit said applicator head to contact said carrying containers to attach said carrying handles;

said X-Y-positioning unit being configured and disposed to move said applicator head about each of said carrying containers to permit said applicator head to attach a first end of each or said carrying handles to a first surface of each corresponding one of said carrying containers and to attach a second end of each or said carrying handles to a second surface of each corresponding one of said carrying containers; and a computer control device being configured and disposed to control the movement of said X-Y-positioning unit according to a movement program;

said method comprising the steps of:

A) conveying with said first conveyor arrangement closed beverage containers from a closing station to said packaging station;

B) packaging with said packaging station closed beverage containers into a first set of carrying containers;

C) conveying with said second conveyor arrangement said first set of carrying containers from said packaging station to said attaching station and through said handle-attaching station;

D) dispensing and attaching with said applicator head strips of material to each of said set of carrying containers to form carrying handles, said step of dispensing and attaching comprising:

E) moving said applicator head adjacent a first carrying container of said first set of carrying containers;

F) contacting with said applicator head said first surface of said first carrying container and attaching a first end of the carrying handle to said first surface of said carrying container;

G) moving said applicator head a predetermined distance above the upper side of said first carrying container to form a carrying handle;

H) determining the length of said carrying handle by the distance that said applicator head is moved away from an upper side of said first carrying container;

I) contacting with said applicator head said second surface of said first carrying container and attaching said second end of said carrying handle to said second surface of said first carrying container;

J) controlling with said computer control device the movement and actions of said X-Y-positioning unit according to a first movement program to control the movement of said applicator head; and K) repeating steps E) to J) for a subsequent second carrying container and each subsequent carrying container of said first set of carrying containers;

said method further comprising programming said computer control device with a plurality of movement programs for carrying containers having different size configurations and for carrying handles having different size configurations;

packaging a second set of carrying containers, wherein each carrying container has a size configuration different from said carrying containers of said first set of carrying containers;

choosing an additional different movement program on said computer control device different from said first movement program, which different movement program is configured to attach carrying handles formed from a different length of strips of material to said second set of carrying containers;

repeating steps C) to K) with the different movement program on said second set of carrying containers and additional sets of carrying containers.

5. The method of operating a beverage container filling plant according to claim 4 wherein said method further comprises the steps of:

moving said carrying containers through said handle-attaching station with said second conveyor arrangement said carrying containers through said handle-attaching station in a spaced apart manner; and moving said applicator head downwardly into and upwardly out of the space between each of said carrying containers by said X-Y-positioning unit downwardly into and upwardly out of the space between each of said carrying containers to permit attachment of said carrying handles.

6. The method of operating a beverage container filling plant according to claim 5, wherein said X-Y positioning unit comprises at least one flexible pulling element.

7. The method of operating a beverage container filling plant according to claim 6, wherein said applicator head comprises a sensor configured to sense the distance away of an approaching carrying container, said method further comprises the step of sensing with said sensor in said applicator head the distance away of an approaching carrying container.

8. The method of operating a beverage container filling plant according to claim 7, wherein said applicator head comprises at least one spray device configured to spray liquid adhesive or hot liquid adhesive on said carrying containers to permit attachment of carrying handles, said method further comprises the step of spraying one of liquid adhesive and hot-liquid adhesive with said at least one spray device of said applicator head on said carrying containers to permit attachment of carrying handles.

9. The method of operating a beverage container filling plant according to claim 8, wherein said method further comprises the step of swinging said at least one spray device about at least one axis by way of a drive arrangement.

10. The method of operating a beverage container filling plant according to claim 9, wherein said step of dispensing and attaching with said applicator head strips of material to each of said first set of carrying containers to form carrying handles further comprises the step of cutting with a cutting arrangement said strips of material.

11. The method of operating a beverage container filling plant according to claim 10, wherein said applicator head comprises a gripper device to grip said carrying handles, said method further comprises the steps of:

gripping with said gripper device said carrying handles for attachment on said carrying containers; and spacing adjacent carrying containers on said second conveyer arrangement upon movement through said handle-attaching station at less than 180 mm.

12. A method of operating a packaging station in a beverage container filling plant for filling beverage containers, such as bottles and cans, with a liquid beverage filling material, said beverage container filling plant comprising:

a packaging station being configured to package a plurality of containers into individual carrying containers;

a first conveyor arrangement being configured and disposed to transfer closed, filled beverage containers to said packaging station from a container closing station;

a handle-attaching station being configured and disposed to attach carrying handles to corresponding carrying containers;

a second conveyor arrangement being configured and disposed to transfer said carrying containers from said packaging station to said handle-attaching station and through said handle-attaching station;

said handle-attaching station comprising an attaching mechanism to attach said carrying handles to said carrying containers;

said attaching mechanism comprising an applicator, head configured and disposed to dispense and attach strips of material to said carrying containers to form said carrying handles;

said attaching mechanism comprising an X-Y positioning unit being configured to move said applicator head horizontally and vertically;

said applicator head being connected to and disposed at an end of said X-Y-positioning unit to permit said applicator head to contact said carrying containers to attach said carrying handles;

said X-Y-positioning unit being configured and disposed to move said applicator head about each of said carrying containers to permit said applicator head to attach a first end of each of said carrying handles to a first surface of each corresponding one of said carrying containers and to attach a second end of each of said carrying handles to a second surface of each corresponding one of said carrying containers; and a computer control device being configured and disposed to control the movement of said X-Y-positioning unit according to a movement program;

said method comprising the steps of:

A) conveying with said first conveyor arrangement closed beverage containers from a closing station to said packaging station;

B) packaging with said packaging station closed beverage containers into a first set of carrying containers;

C) conveying with said second conveyor arrangement said first set of carrying containers from said packaging station to said handle attaching station and through said handle-attaching station;

D) dispensing and attaching with said applicator head strips of material to each of said first set of carrying containers to form carrying handles, said step of dispensing and attaching comprising:

E) moving said applicator head adjacent a first carrying container of said first set of carrying containers;

F) contacting with said applicator head said first surface of said first carrying container and attaching a first end of the carrying handle to said first surface of said first carrying container;

G) moving said applicator head a predetermined distance above the upper side of said first carrying container to form a carrying handle;

H) determining the length of said carrying handle by the distance that said applicator head is away from an upper side of said first carrying container;

I) contacting with said applicator head said second surface of said first carrying container and attaching said second end of said carrying handle to said second surface of said first carrying container;

J) controlling with said computer control device the movement and actions of said X-Y-positioning unit according to a first movement program to control the movement of said applicator head; and K) repeating steps E) to J) for said subsequent, second carrying container and each subsequent carrying container of said first set of carrying containers;

said method further comprising programming said computer control device with a plurality of movement programs for carrying containers having different size configurations and for carrying handles having size configurations configured for said different size configurations.

13. The method of operating a packaging station according to claim 12, wherein said method further comprises the step of moving said carrying containers through said handle-attaching station with said second conveyor arrangement said carrying containers through said handle-attaching station in a spaced apart manner.

14. The method of operating a packaging station according to claim 13 wherein said method further comprises the step of moving said applicator head downwardly into and upwardly out of the space between each of said carrying containers by said X-Y-positioning unit downwardly into and upwardly out of the space between each of said carrying containers to permit attachment of said carrying handles.

15. The method of operating a packaging station according to claim 14, wherein said X-Y-positioning unit comprises at least one flexible pulling element.

16. The method of operating a packaging station according to claim 15, wherein said applicator head comprises a sensor configured to sense the distance away of an approaching carrying container, said method further comprises the step of sensing with said sensor in said applicator head the distance away of an approaching carrying container.

17. The method of operating a packaging station according to claim 16, wherein said applicator head comprises at least one spray device configured to spray liquid adhesive or hot liquid adhesive on said carrying containers to permit attachment of carrying handles, said method further comprises the step of spraying one of liquid adhesive and hot-liquid adhesive with said at least one spray device of said applicator head on said carrying containers to permit attachment of carrying handles.

18. The method of operating a packaging station according to claim 17, wherein said method further comprises the step of swinging said at least one spray device about at least one axis by way of a drive arrangement.

19. The method of operating a packaging station according to claim 18, wherein said step of dispensing and attaching with said applicator head strips of material to each of said first set of carrying containers to form carrying handles further comprises the step of cutting with a cutting arrangement said strips of material.

20. The method of operating a packaging station according to claim 19, wherein said applicator head comprises a gripper device to grip said carrying handles, said method further comprises the steps of:

gripping with said gripper device said carrying handles for attachment on said carrying containers; and spacing adjacent carrying containers on said second conveyer arrangement upon movement through said handle-attaching station at less than 180 mm.

* * * * *

UNITED STATES PATENT AND TRADEMARK OFFICE

CERTIFICATE OF CORRECTION

PATENT NO. : 6,901,720 B2
DATED : June 7, 2005
INVENTOR(S) : Tilo Lechner and Ludger Pauls It is certified that error appears in the above-identified patent and that said Letters Patent is hereby corrected as shown below:

Column 24,
Line 1, after "applicator" delete ",".

Signed and Sealed this

Twenty-third Day of August, 2005

JON W. DUDAS
*Director of the United States Patent and Trademark Office*